US011156214B2

(12) United States Patent
Kuromoto

(10) Patent No.: US 11,156,214 B2
(45) Date of Patent: Oct. 26, 2021

(54) DISPLACER ASSEMBLY AND CRYOCOOLER

(71) Applicant: SUMITOMO HEAVY INDUSTRIES, LTD., Tokyo (JP)

(72) Inventor: Takahiro Kuromoto, Nishitokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 81 days.

(21) Appl. No.: 16/794,197

(22) Filed: Feb. 18, 2020

(65) Prior Publication Data

US 2020/0263676 A1 Aug. 20, 2020

(30) Foreign Application Priority Data

Feb. 19, 2019 (JP) ..... JP2019-027745

(51) Int. Cl.

| | |
|---|---|
| ***F04B 25/04*** | (2006.01) |
| ***F04B 1/124*** | (2020.01) |
| *F25B 9/14* | (2006.01) |

(52) U.S. Cl.

CPC ..... *F04B 25/04* (2013.01); *F04B 1/124* (2013.01); *F25B 9/145* (2013.01); *F25B 2309/1414* (2013.01)

(58) Field of Classification Search

CPC ..... F04B 1/124; F04B 25/04; F04B 37/085; F25B 9/145; F25B 2309/1414; F25B 9/10

See application file for complete search history.

(56) References Cited

FOREIGN PATENT DOCUMENTS

| | | | |
|---|---|---|---|
| JP | H0230852 | U | 2/1990 |
| JP | H0486459 | A | 3/1992 |
| JP | 2015140991 | A | 8/2015 |

*Primary Examiner* — Abiy Teka

(74) *Attorney, Agent, or Firm* — HEA Law PLLC

(57) ABSTRACT

A displacer assembly includes a first displacer including a first displacer lower lid portion and extending along a displacer center axis, a second displacer including a second displacer upper lid portion and disposed so that the second displacer upper lid portion is adjacent to the first displacer lower lid portion along the displacer center axis, and a cross-shaped connector including a first connector pin and a second connector pin, and connecting the second displacer upper lid portion to the first displacer lower lid portion so that the second displacer is inclinable forward, rearward, rightward, and leftward with respect to the first displacer.

16 Claims, 6 Drawing Sheets

10

24

72

18

18

DISPLACER ASSEMBLY AND CRYOCOOLER

RELATED APPLICATIONS

The content of Japanese Patent Application No. 2019-027745, on the basis of which priority benefits are claimed in an accompanying application data sheet, is in its entirety incorporated herein by reference.

BACKGROUND

Technical Field

Certain embodiments of the present invention relate to a displacer assembly and a cryocooler.

Description of Related Art

Some cryocoolers such as a Gifford-McMahon (GM) cryocooler have a displacer that reciprocates to periodically change a volume of an expansion space of working gas. A refrigeration cycle is configured in the cryocooler by causing a periodic pressure fluctuation in the expansion space in proper synchronization with a volumetric fluctuation of the expansion space.

SUMMARY

According to an aspect of the present invention, there is provided a displacer assembly including a first displacer including a first displacer lower lid portion and extending along a displacer center axis, a second displacer including a second displacer upper lid portion and disposed so that the second displacer upper lid portion is adjacent to the first displacer lower lid portion along the displacer center axis, and a cross-shaped connector including a first connector pin and a second connector pin, and connecting the second displacer upper lid portion to the first displacer lower lid portion so that the second displacer is inclinable forward, rearward, rightward, and leftward with respect to the first displacer. The first displacer lower lid portion has a first recessed portion for receiving the second displacer upper lid portion, and a pair of first pin holes penetrating the first displacer lower lid portion in a radial direction on both sides of the first recessed portion across the displacer center axis, and the first connector pin is inserted into the pair of first pin holes so as to be perpendicular to the displacer center axis. The second displacer upper lid portion has a second recessed portion located inside the first recessed portion, and a pair of second pin holes penetrating the second displacer upper lid portion in the radial direction on both sides of the second recessed portion across the displacer center axis, and the second connector pin is inserted into the pair of second pin holes so as to be perpendicular to the displacer center axis. The second connector pin has a horizontal hole located inside the second recessed portion so as to be linearly aligned with the pair of first pin holes, and the first connector pin perpendicularly intersects the second connector pin in the horizontal hole.

According to another aspect of the present invention, there is provided a cryocooler including the displacer assembly.

DETAILED DESCRIPTION

Figure 1:
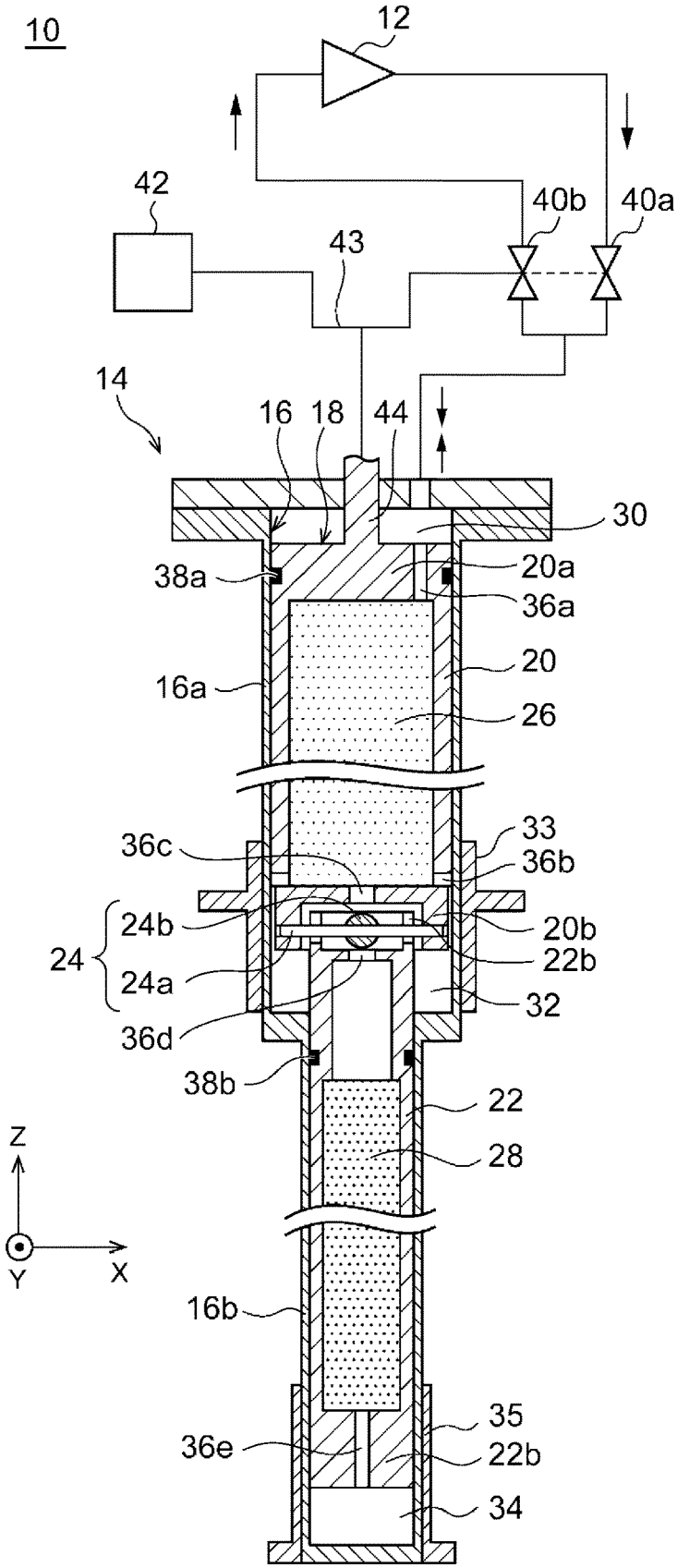
FIG. 1 is a view schematically illustrating a cryocooler according to an embodiment.

An overall shape of a cryocooler having a displacer tends to be lengthened in an axial direction. The reason is that the displacer has an elongated shape in the axial direction and reciprocates in the axial direction. If the cryocooler adopts a multi-stage type such as a two-stage type, two displacers are connected to each other in the axial direction. Accordingly, a total length of the cryocooler is further lengthened.

Usually, the two displacers are not rigidly connected to each other, and are connected to each other so that one displacer can be inclined as much as a certain angular range with respect to the other displacer as in a universal joint. In the related art, a displacer connection portion has a columnar connection rod and two pins. A lower end of one displacer and an upper end of the connection rod are pivotally connected to each other by using one pin, and a lower end of the connection rod and an upper end of the other displacer are pivotally connected to each other by using the other pin. The two pins extend along a first direction (for example, an x-direction) and a second direction (for example, a y-direction) which are perpendicular to the axial direction (for example, a z-direction). The connection rod has a shape extending in the axial direction. Therefore, the displacer connection portion configured in this way may lead to an increase in the total length of the cryocooler.

If a length of the displacer itself is shortened, the total length of the cryocooler is shortened. However, in many cases, a regenerator material is incorporated in the displacer. Therefore, shortening the displacer means decreasing the amount of the regenerator material. It is not desirable to decrease the regenerator material since the decrease may lead to performance degradation of the cryocooler.

As an alternative method of shortening the total length, a method has been proposed on which the two displacers are connected to each other by using only one pin.

However, in this connection structure, an adjustable range of an angle between the two displacers and an inclination direction of the two displacers may be limited, compared to universal joint type connection. For this reason, a performance of the cryocooler is affected depending on an installation posture of the cryocooler at a jobsite using the cryocooler.

It is desirable to shorten the total length while performance degradation is suppressed in a multi-stage type cryocooler.

Any desired combination of the above-described components and those obtained by substituting the components or expressions according to the present invention with each other between methods, devices, and systems are also effective as an aspect of the present invention.

According to the aspect of the present invention, a total length can be shortened while performance degradation is suppressed in a multi-stage type cryocooler.

Hereinafter, an embodiment for embodying the present invention will be described in detail with reference to the drawings. In the description and the drawings, the same reference numerals will be assigned to the same or equivalent components, members, and processes, and repeated description will be omitted as appropriate. A scale or a shape of each element illustrated in the drawings is set for convenience in order to facilitate the description, and is not limitedly interpreted unless otherwise specified. The embodiment is a merely example, and does not limit the scope of the present invention. All features or combinations thereof described in the embodiment are not necessarily essential to the invention.

FIG. 1 is a view schematically illustrating a cryocooler 10 according to the embodiment. As an example, the cryocooler 10 is a two-stage type Gifford-McMahon (GM) cryocooler.

The cryocooler 10 includes a compressor 12 and an expander 14. The compressor 12 is configured to collect working gas of the cryocooler 10 from the expander 14, to pressurize the collected working gas, and to supply the working gas to the expander 14 again. The working gas is also called refrigerant gas, and is typically helium gas. However, other suitable gas may be used.

The expander 14 includes a cylinder unit 16 and a displacer assembly 18. The cylinder unit 16 has a first cylinder 16*a* and a second cylinder 16*b*. The displacer assembly 18 has a first displacer 20, a second displacer 22, and a cross-shaped connector 24.

Although details will be described later, the cross-shaped connector 24 connects a second displacer upper lid portion 22*a* to a first displacer lower lid portion 20*b* so that the second displacer 22 is inclinable forward, rearward, rightward, and leftward with respect to the first displacer 20. The cross-shaped connector 24 includes a first connector pin 24*a* and a second connector pin 24*b*.

In the description herein, in order to conveniently describe a positional relationship between components of the cryocooler 10, a side close to a top dead center of axial reciprocation of the displacer will be referred to as "upward", and a side close to a bottom dead center will be referred to as "downward". The top dead center is a position of the displacer where a volume of an expansion space is maximized, and the bottom dead center is a position of the displacer where the volume of the expansion space is minimized. During an operation of the cryocooler 10, a temperature gradient occurs so that a temperature is lowered downward from above in an axial direction. Accordingly, the upper side can be called a high temperature side, and the lower side can be called a low temperature side.

For convenience of description, as illustrated in FIG. 1, a direction of a displacer center axis may be referred to as a z-direction, and two directions parallel to a plane perpendicular to the displacer center axis and perpendicular to each other may be referred to as an x-direction and an y-direction, in some cases.

The first displacer 20 is accommodated in the first cylinder 16*a*, and the second displacer 22 is accommodated in the second cylinder 16*b*. The first displacer 20 can reciprocate in the z-direction along the first cylinder 16*a*, and the second displacer 22 can reciprocate in the z-direction along the second cylinder 16*b*. The first displacer 20 and the second displacer 22 are connected to each other by the cross-shaped connector 24. Accordingly, both of these are integrally moved.

As an example, the first cylinder 16*a* and the second cylinder 16*b* are members having a cylindrical shape, and the second cylinder 16*b* has a smaller diameter than the first cylinder 16*a*. The first cylinder 16*a* and the second cylinder 16*b* are coaxially disposed, and a lower end of the first cylinder 16*a* is rigidly connected to an upper end of the second cylinder 16*b*. The cylinder unit 16 is a hermetic container that accommodates the displacer assembly 18.

Similarly, as an example, the first displacer 20 and the second displacer 22 are members having a cylindrical shape, and the second displacer 22 has a smaller diameter than the first displacer 20. The first displacer 20 and the second displacer 22 are coaxially disposed, and the first displacer lower lid portion 20*b* is connected to the second displacer upper lid portion 22*a* via the cross-shaped connector 24.

The displacer assembly 18 is bendable in the cross-shaped connector 24 so that a center axis of the second displacer 22 is slightly inclined with respect to a center axis of the first displacer 20. However, as illustrated in FIG. 1, when the displacer assembly 18 is inserted into the cylinder unit 16, a radial clearance is very small between the displacer assembly 18 and the cylinder unit 16. Accordingly, inclination of the second displacer 22 with respect to the first displacer 20 is restricted by the cylinder unit 16. In a case where the displacer assembly 18 is detached from the cylinder unit 16, the second displacer 22 inside an angular range allowed by the cross-shaped connector 24 is freely inclinable in the x-direction and the y-direction with respect to the first displacer 20.

The first displacer 20 accommodates a first regenerator 26. The first regenerator 26 is formed by filling a cylindrical main body of the first displacer 20 with a wire mesh such as copper or other suitable first regenerator materials, for example. The first displacer upper lid portion 20*a* and the first displacer lower lid portion 20*b* may be provided as separate members from the main body of the first displacer 20, and the first displacer upper lid portion 20*a* and the first displacer lower lid portion 20*b* may be fixed to the main body by using suitable means such as fastening or welding.

Similarly, the second displacer 22 accommodates a second regenerator 28. The second regenerator 28 is formed by filling the cylindrical main body of the second displacer 22 with a nonmagnetic regenerator material such as bismuth, a magnetic regenerator material such as HoCu2, or any other suitable second regenerator materials. The second regenerator material may be formed in a granular shape. The second displacer upper lid portion 22*a* and the second displacer lower lid portion 22*b* may be provided as separate members from the main body of the second displacer 22, and the second displacer upper lid portion 22*a* and the second displacer lower lid portion 22*b* may be fixed to the main body by using suitable means such as fastening or welding.

In the displacer assembly 18, a room temperature chamber 30, a first expansion chamber 32, and a second expansion chamber 34 are formed inside the cylinder unit 16. The room temperature chamber 30 is formed between the first displacer upper lid portion 20*a* and an upper portion of the first cylinder 16*a*. The first expansion chamber 32 is formed between the first displacer lower lid portion 20*b* and a lower portion of the first cylinder 16*a*. The second expansion chamber 34 is formed between the second displacer lower lid portion 22*b* and a lower portion of the second cylinder 16*b*.

In order to exchange heat with a desired object or a medium to be cooled by the cryocooler 10, the expander 14 includes a first cooling stage 33 and a second cooling stage 35. The first cooling stage 33 is fixed to the lower portion of the first cylinder 16*a* so as to surround the first expansion chamber 32, and the second cooling stage 35 is fixed to the lower portion of the second cylinder 16*b* so as to surround the second expansion chamber 34.

The first regenerator 26 is connected to the room temperature chamber 30 through a working gas flow path 36*a* formed in the first displacer upper lid portion 20*a*, and is connected to the first expansion chamber 32 through a working gas flow path 36*b* formed in the first displacer lower lid portion 20*b*. The second regenerator 28 is connected to the first regenerator 26 through a working gas flow path 36*c* formed in the first displacer lower lid portion 20*b* and a working gas flow path 36*d* formed in the second displacer upper lid portion 22*a*. The second regenerator 28 is connected to the second expansion chamber 34 through a working gas flow path 36*e* formed in the second displacer lower lid portion 22*b*.

A first seal 38*a* and a second seal 38*b* may be provided so that a flow of the working gas among the first expansion chamber 32, the second expansion chamber 34, and the room temperature chamber 30 is guided to the first regenerator 26 and the second regenerator 28 without passing through a clearance between the cylinder unit 16 and the displacer assembly 18. The first seal 38*a* may be mounted on the first displacer upper lid portion 20*a* so as to be disposed between the first displacer 20 and the first cylinder 16*a*. The second seal 38*b* may be mounted on the second displacer upper lid portion 22*a* so as to be disposed between the second displacer 22 and the second cylinder 16*b*.

The cryocooler 10 has a high-pressure valve 40*a* and a low-pressure valve 40*b* in order to control the pressure of the working gas inside the cylinder unit 16. A working gas discharge port of the compressor 12 is connected to the room temperature chamber 30 via the high-pressure valve 40*a*, and a working gas suction port of the compressor 12 is connected to the room temperature chamber 30 via the low-pressure valve 40*b*. The high-pressure valve 40*a* and the low-pressure valve 40*b* are configured to be selectively and alternately opened and closed (that is, so that the other is closed when one is opened). The working gas having high pressure (for example, 2 to 3 MPa) is supplied from the compressor 12 to the expander 14 through the high pressure valve 40*a*, and the working gas having low pressure (for example, 0.5 to 1.5 MPa) is supplied from the expander 14 to the compressor 12 through the low-pressure valve 40*b*. In order to facilitate understanding, a flowing direction of the working gas is indicated by an arrow in FIG. 1.

The cryocooler 10 has a drive motor 42 that drives the displacer assembly 18 to reciprocate. The drive motor 42 is connected to a displacer drive shaft 44 via a motion conversion mechanism 43 such as a Scotch yoke mechanism, for example. The displacer drive shaft 44 extends from the motion conversion mechanism 43 into the room temperature chamber 30, and is fixed to the first displacer upper lid portion 20*a*. When the drive motor 42 is driven, a rotation output of the drive motor 42 is converted to the axial reciprocation of the displacer drive shaft 44 by the motion conversion mechanism 43, and the displacer assembly 18 reciprocates inside the cylinder unit 16 in the axial direction. The drive motor 42 is connected to the high-pressure valve 40*a* and the low-pressure valve 40*b* so as to selectively and alternately open and close the valves.

When the compressor 12 and the drive motor 42 are operated, the cryocooler 10 generates periodic volume fluctuations in the first expansion chamber 32 and the second expansion chamber 34 and pressure fluctuations of the working gas in synchronization with the volume fluctuations. In this manner, a refrigeration cycle is configured, thereby cooling the first cooling stage 33 and the second cooling stage 35 to a desired cryogenic temperature. The first cooling stage 33 can be cooled to a first cooling temperature in a range of approximately 20 K to 40 K, for example. The second cooling stage 35 can be cooled to a second cooling temperature lower than the first cooling temperature (for example, approximately 1 K to 4 K).

Figure 2:
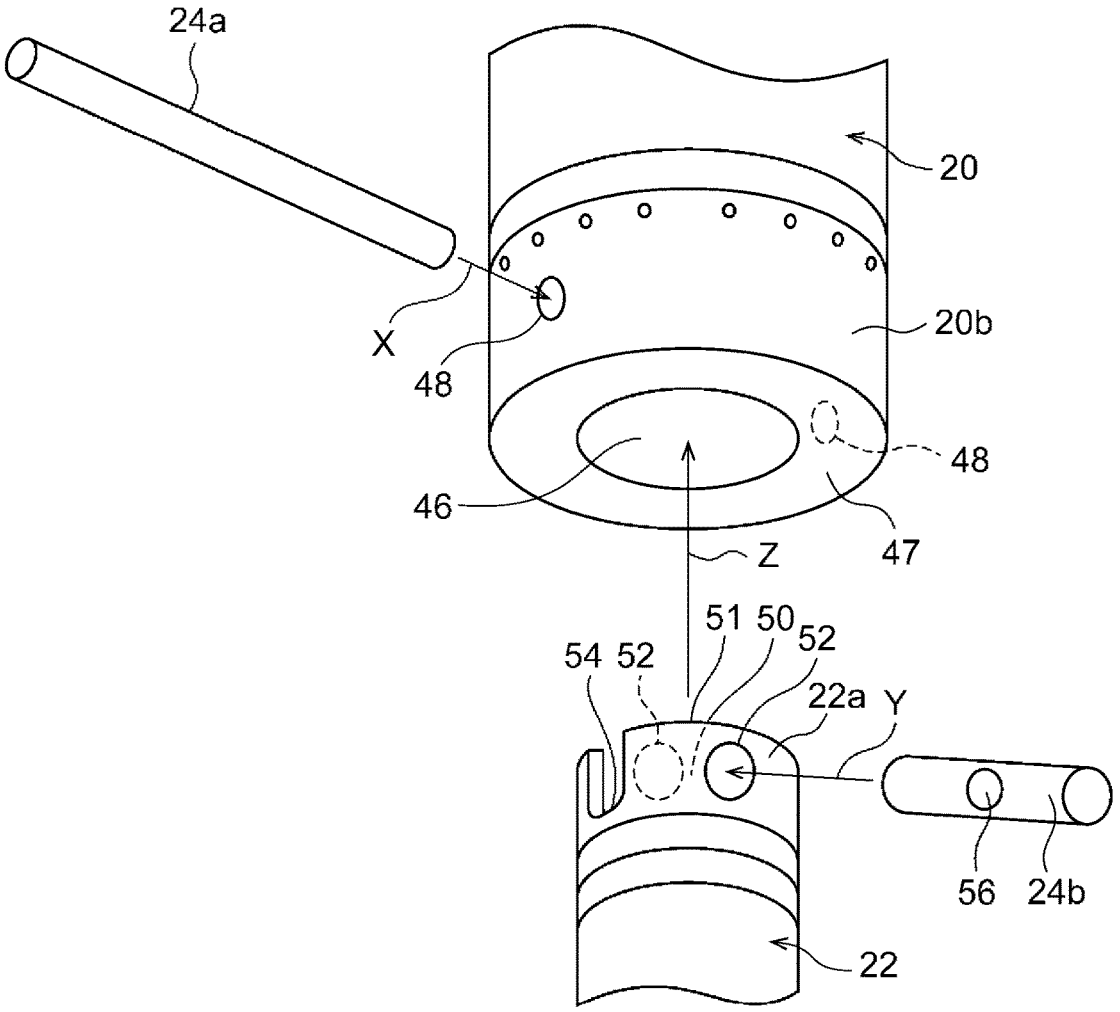
FIG. 2 is an exploded perspective view schematically illustrating a displacer assembly according to the embodiment.
Figure 3A:
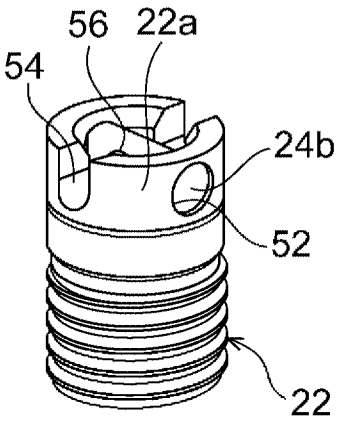
FIGS. 3A to 3C are schematic views illustrating an assembly procedure of the displacer assembly according to the embodiment.
Figure 3B:
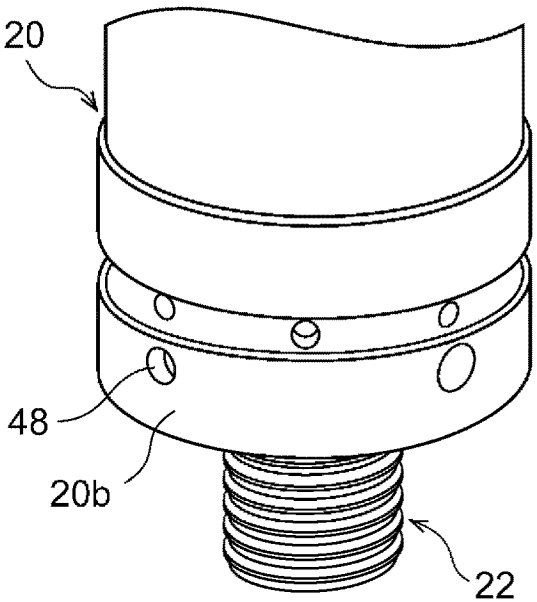
Figure 3C:
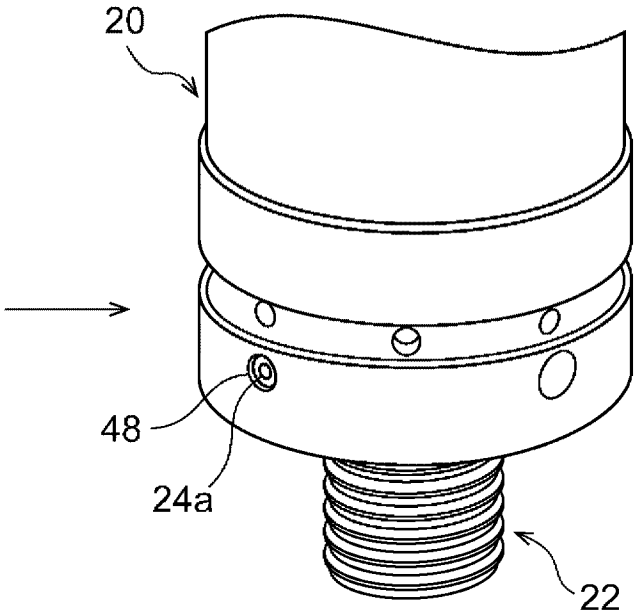
Figure 4:
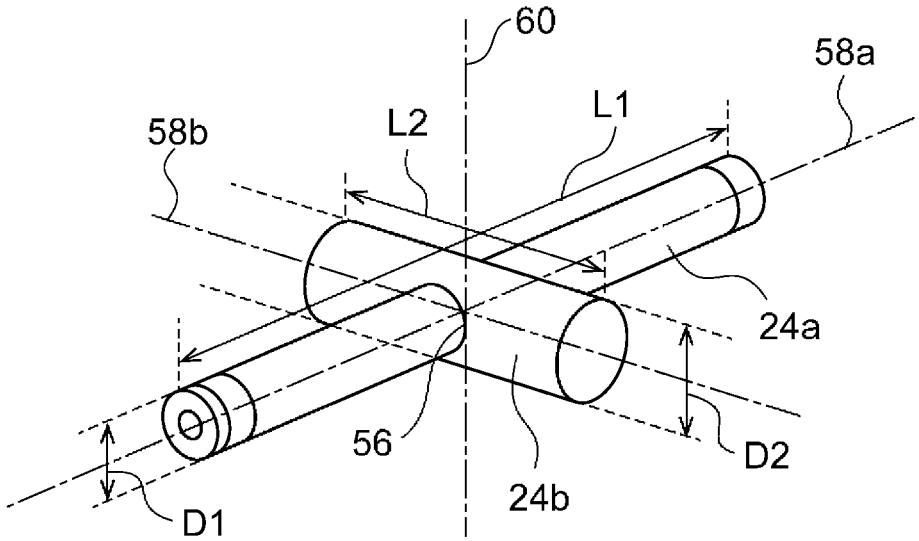
FIG. 4 is a schematic perspective view illustrating a cross-shaped connector according to the embodiment.
Figure 5A:
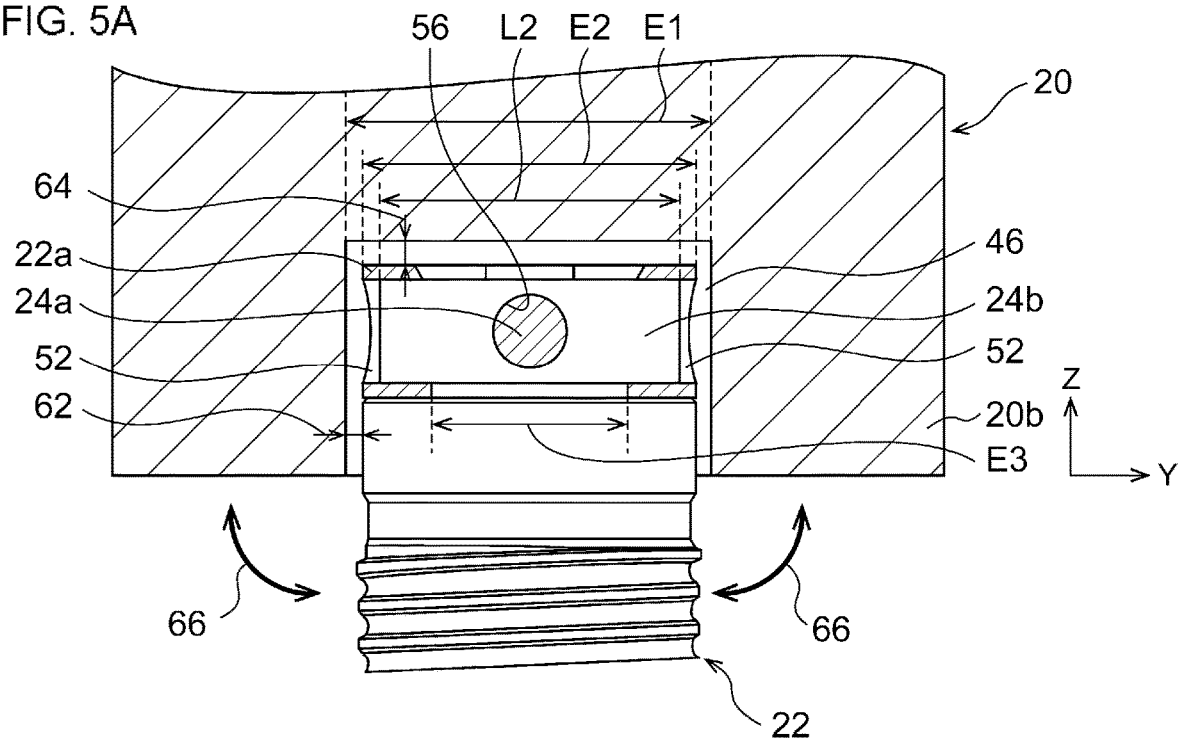
FIG. 5A is a schematic sectional view of a connection portion of the displacer assembly according to the embodiment, which is taken along an yz-plane.
Figure 5B:
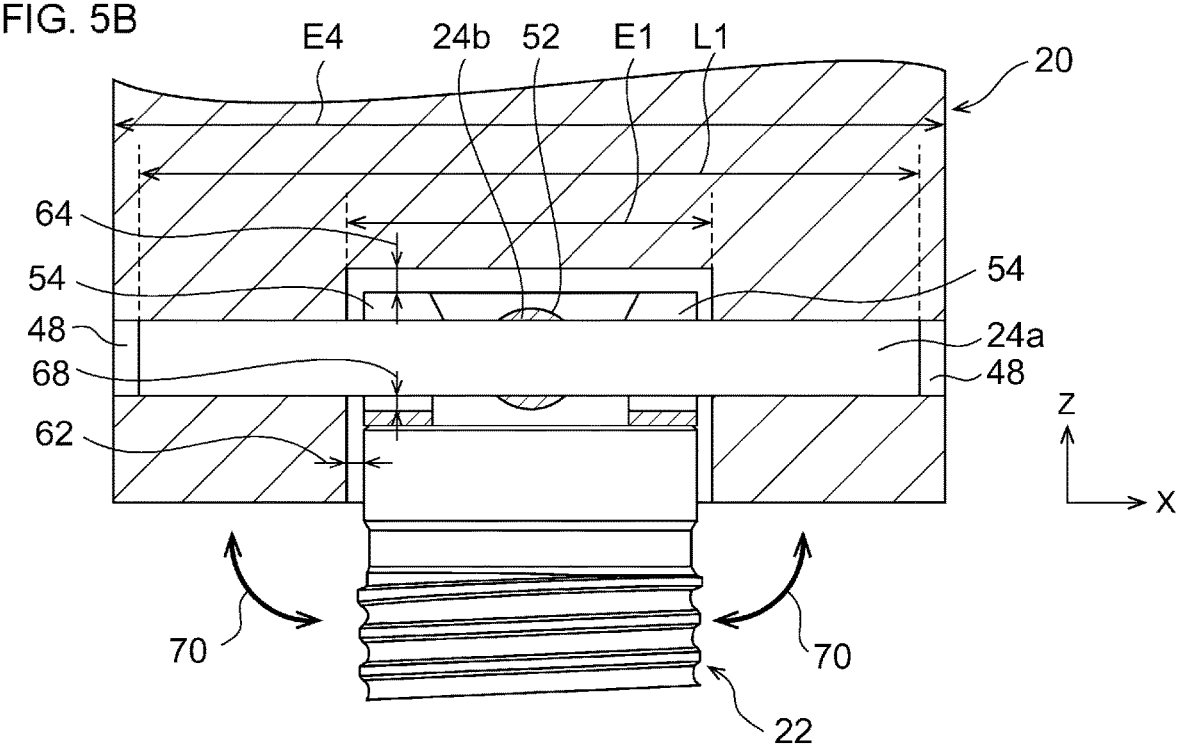
FIG. 5B is a schematic sectional view of the connection portion of the displacer assembly according to the embodiment, which is taken along an xz-plane.

FIG. 2 is an exploded perspective view schematically illustrating the displacer assembly 18 according to the embodiment. FIGS. 3A to 3C are schematic views illustrating an assembly procedure of the displacer assembly 18 according to the embodiment. FIG. 4 is a schematic perspective view illustrating the cross-shaped connector 24 according to the embodiment. FIG. 5A is a schematic sectional view of a connection portion of the displacer assembly 18 according to the embodiment, which is taken along an yz-plane, and FIG. 5B is a schematic sectional view of the connection portion of the displacer assembly 18 according to the embodiment, which is taken along an xz-plane.

As illustrated in FIGS. 1 and 2, the first displacer 20 extends along the displacer center axis (z-direction), and the second displacer 22 is disposed so that the second displacer upper lid portion 22*a* is adjacent to the first displacer lower lid portion 20*b* along the displacer center axis.

The first displacer lower lid portion 20*b* has a first recessed portion 46 for receiving the second displacer upper lid portion 22*a*. The first displacer lower lid portion 20*b* is formed to surround the first recessed portion 46, and the first recessed portion 46 is open on a lower end surface 47 of the first displacer lower lid portion 20*b*. For example, the first recessed portion 46 is a columnar opening portion, and the first displacer lower lid portion 20*b* has a cylindrical shape which surrounds the opening portion.

The first displacer lower lid portion 20*b* has a pair of first pin holes 48 penetrating the first displacer lower lid portion 20*b* in the radial direction (x-direction). The first pin hole 48 is located on both sides of the first recessed portion 46 across the displacer center axis. The two first pin holes 48 extend from side surfaces of the first displacer lower lid portion 20*b* to the first recessed portion 46, and are linearly aligned along the diameter of the first displacer lower lid portion 20*b*.

The second displacer upper lid portion 22*a* has a second recessed portion 50 located inside the first recessed portion 46 when the second displacer upper lid portion 22*a* is inserted into the first recessed portion 46. The second displacer upper lid portion 22*a* is formed to surround the second recessed portion 50, and the second recessed portion 50 is open on an upper end surface 51 of the second displacer upper lid portion 22*a*. For example, the second recessed portion 50 is a columnar opening portion, and the second displacer upper lid portion 22*a* has a cylindrical shape which surrounds the opening portion.

The second displacer upper lid portion 22*a* has a pair of second pin holes 52 penetrating the second displacer upper lid portion 22*a* in the radial direction (y-direction). The second pin hole 52 is located on both sides of the second recessed portion 50 across the displacer center axis. The two second pin holes 52 extend from side surfaces of the second displacer upper lid portion 22*a* to the second recessed portion 50, and are linearly aligned along the diameter of the second displacer upper lid portion 22*a*.

Furthermore, the second displacer upper lid portion 22*a* has a pair of connector pin receiving portions 54 for receiving the first connector pin 24*a*. FIG. 2 illustrates one of the connector pin receiving portions 54 for convenience of illustration. The connector pin receiving portion 54 is located on both sides of the second recessed portion 50 across the displacer center axis, and penetrates the second displacer upper lid portion 22*a* in the radial direction (x-direction). For example, the connector pin receiving portion 54 is formed as a U-shaped groove or notch. However, the connector pin receiving portion 54 may be a groove having another shape or a hole such as the second pin hole 52. The two connector pin receiving portions 54 extend from the side surfaces of the second displacer upper lid portion 22*a* to the second recessed portion 50, and are linearly arranged along the diameter of the second displacer upper lid portion 22*a*. When the second displacer upper lid portion 22*a* is inserted into the first recessed portion 46, the connector pin receiving portion 54 and the first pin hole 48 are linearly aligned along the diameter of the first displacer lower lid portion 20*b*.

When the displacer assembly 18 is assembled, the second connector pin 24*b* is first inserted into the pair of second pin holes 52 (in the y-direction) as illustrated in FIGS. 2 and 3A. The second connector pin 24*b* is disposed on the second displacer upper lid portion 22*a* so as to be perpendicular to the displacer center axis. For example, the second connector pin 24*b* and the second pin hole 52 are fitted to each other by means of loose fitting. Accordingly, the second connector pin 24*b* is rotatable around the center axis of the second connector pin 24*b* with respect to the second displacer upper lid portion 22*a* in a state where the second connector pin 24*b* is inserted into the second pin hole 52. The second connector pin 24*b* is only inserted into the second pin hole 52, and the second connector pin 24*b* is not fixed to the second displacer upper lid portion 22*a*.

The second connector pin 24*b* has a horizontal hole 56 located inside the second recessed portion 50 when the second connector pin 24*b* is inserted into the second pin hole 52. The horizontal hole 56 penetrates the second connector pin 24*b* in an intermediate portion in the direction of the center axis of the second connector pin 24*b*. A position can be adjusted inside the second recessed portion 50 by rotating the second connector pin 24*b* so that the horizontal hole 56 is linearly aligned with the connector pin receiving portion 54.

Next, as illustrated in FIGS. 2 and 3B, the second displacer 22 is inserted into the first recessed portion 46 of the first displacer lower lid portion 20*b*. The second displacer upper lid portion 22*a* is disposed inside the first recessed portion 46. In this case, positions of the first displacer lower lid portion 20*b* and the second displacer lower lid portion 22*b* can be aligned with each other so that the connector pin receiving portion 54 and the horizontal hole 56 are linearly aligned with the pair of first pin holes 48.

As illustrated in FIGS. 2 and 3C, the first connector pin 24*a* is inserted into the pair of first pin holes 48 (in the x-direction). The first pin hole 48, the connector pin receiving portion 54, and the horizontal hole 56 are linearly aligned. Accordingly, the first connector pin 24*a* is inserted into the first displacer lower lid portion 20*b* and the horizontal hole 56 so as to be perpendicular to the displacer center axis. In this way, the first displacer 20 is connected to the second displacer 22, and the displacer assembly 18 is completely assembled.

For example, the first connector pin 24*a* and the first pin hole 48 are fitted to each other by means of loose fitting. Similarly, the first connector pin 24*a* and the horizontal hole 56 of the second connector pin 24*b* are fitted to each other by means of loose fitting. Accordingly, the first connector pin 24*a* is rotatable around the center axis of the first connector pin 24*a* with respect to the first displacer lower lid portion 20*b* in a state where the first connector pin 24*a* is inserted into the first pin hole 48 and the horizontal hole 56. The first connector pin 24*a* is only inserted into the first pin hole 48 and the horizontal hole 56, and the first connector pin 24*a* is not fixed to the first displacer lower lid portion 20*b* and the second connector pin 24*b*. In this case, the first connector pin 24*a* is not in contact with the connector pin receiving portion 54. A clearance larger than a fitting tolerance between the first connector pin 24*a* and the first pin hole 48 (or the horizontal hole 56) is present between the first connector pin 24*a* and the connector pin receiving portion 54.

FIG. 4 illustrates a state where the first connector pin 24*a* is inserted into the horizontal hole 56 of the second connector pin 24*b*. The first connector pin 24*a* perpendicularly intersects the second connector pin 24*b* in the horizontal hole 56. As illustrated, a center axis 58*a* of the first connector pin 24*a* and a center axis 58*b* of the second connector pin 24*b* are perpendicular to each other on one plane perpendicular to a displacer center axis 60. The cross-shaped connector 24 is assembled to the displacer assembly 18 in this state.

The cross-shaped connector 24 consists of only two components, that is, the first connector pin 24*a* and the second connector pin 24*b*. Both the first connector pin 24*a* and the second connector pin 24*b* have a columnar shape. The second connector pin 24*b* is thicker and shorter than the first connector pin 24*a*. That is, a diameter D2 of the second connector pin 24*b* is larger than a diameter D1 of the first connector pin 24*a*, and a length L2 of the second connector pin 24*b* is shorter than a length L1 of the first connector pin 24*a*. The second connector pin 24*b* is thicker than the first connector pin 24*a*. Accordingly, the horizontal hole 56 can be formed in the second connector pin 24*b*.

As illustrated in FIG. 5A, an inner diameter (that is, diameter of the first recessed portion 46) E1 of the first displacer lower lid portion 20*b* is slightly larger than an outer diameter E2 of the second displacer upper lid portion 22*a*. In this manner, a radial clearance 62 is formed between the inner diameter of the first displacer lower lid portion 20*b* and the outer diameter of the second displacer upper lid portion 22*a*. An axial clearance 64 is also formed in the axial direction between the first displacer lower lid portion 20*b* and the second displacer upper lid portion 22*a*. For example, the radial clearance 62 and the axial clearance 64 are respectively clearances having a size of several mm (for example, approximately 1 to 2 mm).

As described above, the first connector pin 24*a* is inserted into the horizontal hole 56 of the second connector pin 24*b*, and the second connector pin 24*b* is rotatable around the first connector pin 24*a* in the horizontal hole 56. Therefore, the second displacer 22 is rotatable around the first connector pin 24*a* together with the second connector pin 24*b* with respect to the first displacer 20 inside an angular range determined by the radial clearance 62 and the axial clearance 64 (arrow 66).

The length L2 of the second connector pin 24*b* is set not to interfere with the first displacer 20. The length L2 of the second connector pin 24*b* is shorter than the inner diameter E1 of the first displacer lower lid portion 20*b*. The length L2 of the second connector pin 24*b* is determined so that the second connector pin 24*b* does not protrude out of the second pin hole 52. The length L2 of the second connector pin 24*b* is shorter than the outer diameter E2 of the second displacer upper lid portion 22*a*. In order that both ends of the second connector pin 24*b* are supported by the second pin hole 52, the length L2 of the second connector pin 24*b* is set to be longer than an inner diameter (that is, diameter of the second recessed portion 50) E3 of the second displacer upper lid portion 22*a*.

As illustrated in FIG. 5B, a pin receiving clearance 68 is formed between the first connector pin 24*a* and the second displacer upper lid portion 22*a* in the connector pin receiving portion 54. The pin receiving clearance 68 may be a clearance which is approximately the same as the radial clearance 62 and the axial clearance 64. As described above, the second connector pin 24*b* is rotatably inserted into the second pin hole 52. Accordingly, the second displacer 22 is rotatable around the second connector pin 24*b* with respect to the first displacer 20 inside an angular range determined by the radial clearance 62, the axial clearance 64, and the pin receiving clearance 68 (arrow 70).

The length L1 of the first connector pin 24*a* is determined so that the first connector pin 24*a* does not protrude out of the first pin hole 48. The length L1 of the first connector pin 24*a* is shorter than an outer diameter E4 of the first displacer lower lid portion 20*b*. In order that both ends of the first connector pin 24*a* are supported by the first pin hole 48, the length L1 of the first connector pin 24*a* is longer than the inner diameter E1 of the first displacer lower lid portion 20*b*.

In this way, the first displacer 20 and the second displacer 22 are connected to each other so that the second displacer 22 is inclinable forward, rearward, rightward, and leftward with respect to the first displacer 20 by the cross-shaped connector 24. In the cross-shaped connector 24, a connection portion such as a universal joint can be formed in the displacer assembly 18. The second displacer 22 is inclined by the cross-shaped connector 24. In this manner, the second displacer lower lid portion 22*b* can be moved in the x-direction and the y-direction within a range of approximately ±5 mm, for example.

Figure 6:
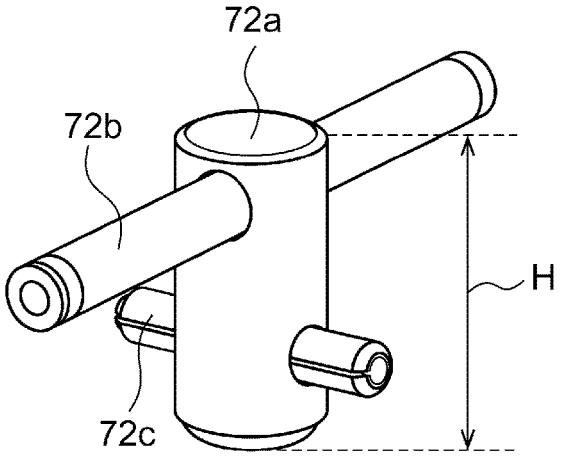
FIG. 6 illustrates a displacer connection portion according to a comparative example.

FIG. 6 illustrates a displacer connection portion according to a comparative example. A displacer connection portion 72 consists of three components. The displacer connection portion 72 consists of a columnar connection rod 72*a* and two pins. The lower end of one displacer and the upper end of the connection rod 72*a* are pivotally connected to each other by the first pin 72*b*, and the lower end of the connection rod 72*a* and the upper end of the other displacer are pivotally connected to each other by the second pin 72*c*. The first pin 72*b* and the second pin 72*c* are located at different height positions, and respectively extend along the first direction and the second direction which are perpendicular to the axial direction. The connection rod 72*a* has an elongated shape extending in the axial direction. Therefore, the displacer connection portion 72 has a height H in the axial direction.

In contrast, as illustrated in FIG. 4, in the cross-shaped connector 24, the first connector pin 24*a* perpendicularly intersects the second connector pin 24*b* in the horizontal hole 56. Preferably, the center axis 58*a* of the first connector pin 24*a* and the center axis 58*b* of the second connector pin 24*b* are perpendicular to each other on one plane perpendicular to the displacer center axis 60.

Accordingly, the height of the cross-shaped connector 24 in the axial direction is suppressed to the diameter D2 of the second connector pin 24*b*. The height of the cross-shaped connector 24 in the axial direction is considerably lower than that according to the comparative example illustrated in FIG. 6. Therefore, compared to the axial length of the comparative example, the axial length of the displacer assembly 18 according to the embodiment can be shortened by several percent, for example. The length itself of the first displacer 20 and the second displacer 22 does not need to be shortened. Accordingly, the amount of the regenerator material does not have to be reduced. Therefore, the total length can be shortened while cooling performance degradation of the cryocooler 10 is suppressed.

A fact that the second displacer upper lid portion 22*a* has the connector pin receiving portion 54 contributes to shortening the axial length of the displacer assembly 18. In this manner, the first connector pin 24*a* can be inserted below the upper end surface 51 of the second displacer upper lid portion 22*a*, and the axial height of the connection portion is lowered.

According to the embodiment, there is an advantage in that the assembling process of the displacer assembly 18 is relatively facilitated. After the second connector pin 24*b* is inserted into the second displacer upper lid portion 22*a*, the first pin hole 48 and the horizontal hole 56 of the first displacer lower lid portion 20*b* are linearly aligned, and the first connector pin 24*a* is inserted into the holes. In this way, the cross-shaped connector 24 is formed, and the first connector pin 24*a* is supported by the first displacer lower lid portion 20*b*, thereby enabling the displacer assembly 18 to be assembled. Assuming a case of using a cross-shaped connection pin having two integrally formed connector pins, the displacer assembly 18 is not so easily assembled.

Figure 7A:
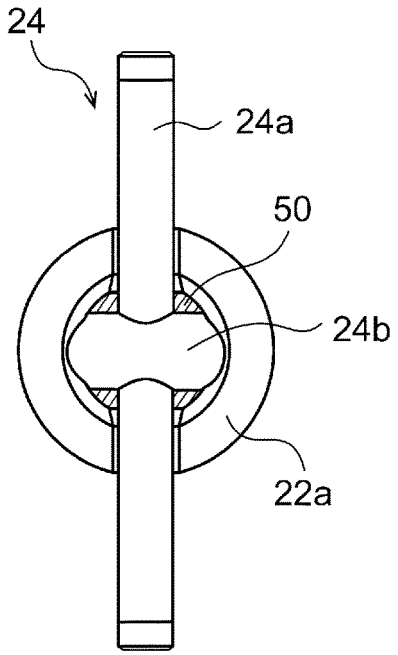
FIGS. 7A and 7B are schematic views illustrating another example of the displacer assembly according to the embodiment.
Figure 7B:
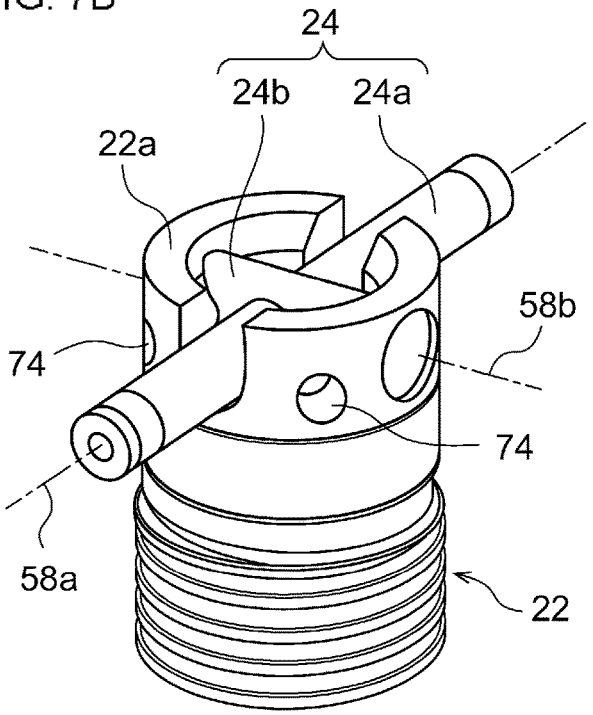

FIGS. 7A and 7B are schematic views illustrating another example of the displacer assembly 18 according to the embodiment. FIG. 7A is a view when the cross-shaped connector 24 and the second displacer upper lid portion 22*a* are viewed from above, and FIG. 7B is a schematic perspective view of the cross-shaped connector 24 and the second displacer upper lid portion 22*a*.

The second recessed portion 50 of the second displacer upper lid portion 22*a* serves as a flow path of the working gas. However, the flow path through which the working gas can actually flow is an area (hatched portion in FIG. 7A) interposed between the second displacer upper lid portion 22*a* and the cross-shaped connector 24. However, the first connector pin 24*a* and the second connector pin 24*b* intersect each other in a cross-shaped manner inside the second recessed portion 50. Accordingly, the area tends to be narrowed. If the flowing working gas is reduced, cooling capacity of the second stage of the cryocooler 10 may be degraded.

Therefore, in the displacer assembly 18 illustrated in FIGS. 7A and 7B, the second displacer upper lid portion 22*a* includes a refrigerant gas inlet 74 penetrating the second displacer upper lid portion 22*a* in the radial direction, below the center axis 58*a* of the first connector pin 24*a* and the center axis 58*b* of the second connector pin 24*b*.

The refrigerant gas inlet 74 is formed between the second pin hole 52 and the connector pin receiving portion 54 in the second displacer upper lid portion 22*a*. In the illustrated example, the refrigerant gas inlet 74 is a circular hole. However, as in the connector pin receiving portion 54, the refrigerant gas inlet 74 may be a U-shaped groove, for example.

The refrigerant gas inlet 74 is additionally provided. Accordingly, a larger amount of the working gas can be guided into the second displacer 22 through the second recessed portion 50. Therefore, cooling capacity degradation of the second stage of the cryocooler 10 is suppressed.

Hitherto, the present invention has been described with reference to the examples. The present invention is not limited to the above-described embodiments, and design can be changed in various ways. It will be understood by those skilled in the art that various modification examples can be adopted and the modification examples also fall within the scope of the present invention. Various features described with regard to one embodiment are applicable to other embodiments. A new embodiment adopted in combination with the above-described embodiment has each advantageous effect of the combined embodiments.

In the above-described embodiment, the displacer assembly 18 is mechanically connected to and driven by the drive motor 42. However, the cryocooler 10 is not limited to the motor-driven type. The cryocooler 10 may be a gas-driven type. In this case, instead of the motion conversion mechanism 43, a piston is fixed to the displacer drive shaft 44, and the pressure acting on the piston is controlled. In this manner, the displacer assembly 18 is driven to reciprocate.

The present invention has been described using specific terms and phrases with reference to the embodiment. However, the embodiment merely shows one aspect of the principle and application of the present invention. Many modification examples and disposition changes may be made within the scope not departing from the concept of the invention disclosed in the appended claims.

It should be understood that the invention is not limited to the above-described embodiment, but may be modified into various forms on the basis of the spirit of the invention. Additionally, the modifications are included in the scope of the invention.

What is claimed is:

1. A displacer assembly comprising:

a first displacer including a first displacer lower lid portion extending along a displacer center axis;

a second displacer including a second displacer upper lid portion, disposed so that the second displacer upper lid portion is adjacent to the first displacer lower lid portion along the displacer center axis; and a cross-shaped connector including a first connector pin and a second connector pin, connecting the second displacer upper lid portion to the first displacer lower lid portion so that the second displacer is inclinable forward, rearward, rightward, and leftward with respect to the first displacer, wherein the first displacer lower lid portion has a first recessed portion for receiving the second displacer upper lid portion, and has a pair of first pin holes penetrating the first displacer lower lid portion in a radial direction on both sides of the first recessed portion across the displacer center axis, and wherein the first connector pin is located in the pair of first pin holes so as to be perpendicular to the displacer center axis, wherein the second displacer upper lid portion has a second recessed portion located inside the first recessed portion, and has a pair of second pin holes penetrating the second displacer upper lid portion in the radial direction on both sides of the second recessed portion across the displacer center axis, and wherein the second connector pin is located in the pair of second pin holes so as to be perpendicular to the displacer center axis, and wherein the second connector pin has a horizontal hole located inside the second recessed portion so as to be linearly aligned with the pair of first pin holes, and wherein the first connector pin perpendicularly intersects the second connector pin in the horizontal hole.

2. The displacer assembly according to claim 1, wherein a center axis of the first connector pin and a center axis of the second connector pin are perpendicular to each other on a plane perpendicular to the displacer center axis.

3. The displacer assembly according to claim 1, wherein the second displacer upper lid portion includes a refrigerant gas inlet penetrating the second displacer upper lid portion in the radial direction below a center axis of the first connector pin and a center axis of the second connector pin.

4. The displacer assembly according to claim 3, wherein the refrigerant gas inlet is formed between the second pin hole and a connector pin receiving portion in the second displacer upper lid portion.

5. The displacer assembly according to claim 1 further comprising:

a connector pin receiving portion for receiving the first connector pin in the second displacer upper lid portion.

6. The displacer assembly according to claim 5, wherein the connector pin receiving portion is a U-shaped groove or notch.

7. The displacer assembly according to claim 5, wherein when the second displacer upper lid portion is inserted into the first recessed portion, the connector pin receiving portion and the first pin hole are linearly aligned with each other along a diameter of the first displacer lower lid portion.

8. The displacer assembly according to claim 5, wherein a clearance larger than a fitting tolerance between the first connector pin and the first pin hole is present between the first connector pin and the connector pin receiving portion.

9. The displacer assembly according to claim 1, wherein the first displacer lower lid portion is formed to surround the first recessed portion, and the first recessed portion is open on a lower end surface of the first displacer lower lid portion.

10. The displacer assembly according to claim 9, wherein the first recessed portion is a columnar opening portion, and the first displacer lower lid portion has a cylindrical shape so as to surround the columnar opening portion.

11. The displacer assembly according to claim 10, wherein the second recessed portion is a columnar opening portion, and the second displacer upper lid portion has a cylindrical shape so as to surround the columnar opening portion.

12. The displacer assembly according to claim 11, wherein a length of the second connector pin is shorter than an inner diameter of the first displacer lower lid portion, and the length of the second connector pin is longer than an inner diameter of the second displacer upper lid portion.

13. The displacer assembly according to claim 1, wherein the second connector pin is rotatable around a center axis of the second connector pin with respect to the second displacer upper lid portion, in a state where the second connector pin is inserted into the second pin hole.

14. The displacer assembly according to claim 1, wherein a diameter of the second connector pin is larger than a diameter of the first connector pin, and wherein a length of the second connector pin is shorter than a length of the first connector pin.

15. The displacer assembly according to claim 1, wherein the first displacer accommodates a first regenerator, and the second displacer accommodates a second regenerator.

16. A cryocooler comprising:

a first displacer including a first displacer lower lid portion extending along a displacer center axis;

a second displacer including a second displacer upper lid portion, disposed so that the second displacer upper lid portion is adjacent to the first displacer lower lid portion along the displacer center axis; and a cross-shaped connector including a first connector pin and a second connector pin, connecting the second displacer upper lid portion to the first displacer lower lid portion so that the second displacer is inclinable forward, rearward, rightward, and leftward with respect to the first displacer, wherein the first displacer lower lid portion has a first recessed portion for receiving the second displacer upper lid portion, and has a pair of first pin holes penetrating the first displacer lower lid portion in a radial direction on both sides of the first recessed portion across the displacer center axis, and wherein the first connector pin is located in the pair of first pin holes so as to be perpendicular to the displacer center axis, wherein the second displacer upper lid portion has a second recessed portion located inside the first recessed portion, and has a pair of second pin holes penetrating the second displacer upper lid portion in the radial direction on both sides of the second recessed portion across the displacer center axis, and wherein the second connector pin is located in the pair of second pinholes so as to be perpendicular to the displacer center axis, and wherein the second connector pin has a horizontal hole located inside the second recessed portion so as to be linearly aligned with the pair of first pin holes, and wherein the first connector pin perpendicularly intersects the second connector pin in the horizontal hole.

* * * * *